US012546037B1

(12) United States Patent
Ke et al.

(10) Patent No.: US 12,546,037 B1
(45) Date of Patent: Feb. 10, 2026

(54) PREPARATION PROCESS FOR WARP-KNITTED JACQUARD MULTI-LAYER JACQUARD SHOE UPPER FABRIC

(71) Applicant: FUJIAN JINJIANG HUAYU WEAVING CO., LTD., Quanzhou (CN)

(72) Inventors: Wenxin Ke, Quanzhou (CN); Enping Lin, Quanzhou (CN); Chengyu Su, Quanzhou (CN); Yingxian Yang, Quanzhou (CN)

( * ) Notice: Subject to any disclaimer, the term of this patent is extended or adjusted under 35 U.S.C. 154(b) by 0 days.

(21) Appl. No.: 19/223,621

(22) Filed: May 30, 2025

(30) Foreign Application Priority Data

May 20, 2025 (CN) ..... 202510649481.7

(51) Int. Cl.
*D04B 21/06* (2006.01)
*D04B 21/20* (2006.01)

(52) U.S. Cl.
CPC ..... *D04B 21/06* (2013.01); *D04B 21/207* (2013.01); *D10B 2501/043* (2013.01)

(58) Field of Classification Search
CPC ..... D04B 21/06; D04B 21/08; D04B 21/10; D04B 21/12; D04B 21/207; A41B 1/04
See application file for complete search history.

(56) References Cited

U.S. PATENT DOCUMENTS 3,834,193 A * 9/1974 Wilkens ..... D04B 27/32 66/84 R
5,596,888 A * 1/1997 McLarty, III ..... D04B 21/18 66/195
5,899,095 A * 5/1999 Spillane ..... D04B 21/08 66/195
10,030,328 B2 * 7/2018 Lonati ..... D04B 21/08
10,443,165 B2 * 10/2019 Cai ..... D04B 23/02
11,441,250 B2 * 9/2022 Jiang ..... D04B 21/06
2012/0159813 A1 * 6/2012 Dua ..... A43B 9/02 36/84
2012/0255201 A1 * 10/2012 Little ..... A43D 111/00 12/142 R
2017/0107649 A1 * 4/2017 Lonati ..... D04B 21/04
2020/0063301 A1 * 2/2020 Takayama ..... D04B 21/06
2024/0352634 A1 * 10/2024 Ota ..... D04B 21/08

FOREIGN PATENT DOCUMENTS

CN 113430705 A 9/2021
CN 115506077 A 12/2022

* cited by examiner

*Primary Examiner* — Danny Worrell

(57) ABSTRACT

The present application relates to the technical field of textiles and provides a preparation process for a warp-knitted jacquard multi-layer jacquard shoe upper fabric, aiming to solve the problems of insufficiently rich jacquard variation layers, relatively poor fabric strength, and the inability to simultaneously achieve lightweight and breathable effects in existing warp-knitted double jacquard single-layer fabrics. The process includes: (1) Guide Bar Setup: The guide bars of the weaving machine include ground guide bars, pattern guide bars, and jacquard guide bars. (2) Guide Bar Threading and Weaving: The ground guide bars GB1 and GB2 are fully threaded. The pattern guide bars PB3-PB74 are threaded according to the designed pattern effects to form arbitrary weft-inserted jacquard structures. The ground guide bar GB1 wraps all other layers of yarns through loops and underlaps. The ground guide bar GB2 locks all layers of yarns except GB1.

9 Claims, 6 Drawing Sheets

PREPARATION PROCESS FOR WARP-KNITTED JACQUARD MULTI-LAYER JACQUARD SHOE UPPER FABRIC

CROSS-REFERENCE TO RELATED APPLICATIONS

The present application claims priority to Chinese patent application No. 202510649481.7, titled "preparation process for warp-knitted jacquard multi-layer jacquard shoe upper fabric", filed on May 20, 2025, the entire contents of which are incorporated herein by reference.

TECHNICAL FIELD

The present application relates to the technical field of textiles, and in particular, to a preparation process for a warp-knitted jacquard multi-layer jacquard shoe upper fabric.

BACKGROUND

With the continuous increase in the sports footwear and apparel industry's demand for functionality, aesthetics, and production efficiency, warp-knitted jacquard shoe upper fabrics have gradually become one of the core technologies for high-end sports shoe materials due to their unique three-dimensional structure, programmable jacquard effects, and efficient production characteristics. Traditional warp-knitted shoe upper materials mostly rely on warp beam yarn supply systems, and achieves basic jacquard through spacer layers or double jacquard devices. However, limited by yarn feeding methods and structural designs, their pattern layers and color performance are restricted, making it difficult to meet the market's urgent needs for personalized and complex designs.

Existing warp-knitted double jacquard single-layer fabrics have only two layers of jacquard variation. The variation range of each jacquard yarn is limited to a shift of one needle pitch from its original position, allowing for limited structural changes within a total range of generally 3-4 needle pitches. In a single fabric, a fully threaded jacquard guide bar (1,100 yarns) typically can only accommodate one type of yarn; in special cases, it can be equally divided into two types at most. The thickness range of jacquard raw materials is generally 75D-300D, and thicker yarns are more difficult to weave with unstable quality.

Existing products are warp-knitted multi-guide bar jacquard single-needle bed fabrics, in which materials of arbitrary thickness are threaded at required positions within a fixed cycle according to designed patterns. These materials can form rich patterns through large-range lapping (16N per cycle, 350N cumulative) based on set lapping codes. The required textures are pieced together by multiple groups (72 bars) of pattern guide bars with different independent lappings to meet the needs of local embroidery textures; however, traditional jacquard raw materials and patterns have certain limitations.

A Chinese Patent Application No. CN202211124887.6 discloses a novel warp-knitted double jacquard double creel shoe upper fabric and weaving method. The fabric includes a first color block jacquard area, which comprises a chain stitch formed by the first yarn on the front needle bed via ground guide bars, structures 1-0-1-1/2-3-2-2// and 2-3-2-2/1-0-1-1// formed by the second yarn through loop formation on front and back needle beds via jacquard guide bars JB2.1 and JB3.1, structures 2-2-2-3/1-1-1-0// and 1-1-1-0/2-2-2-3// formed by the third yarn through lapping and loop formation on front and back needle beds via jacquard guide bars JB2.2 and JB3.2, a chain stitch formed by the fourth yarn on the back needle bed via ground guide bars, three-needle tricot stitch formed on the back needle bed by the fifth needle bed. This invention uses jacquard guide bars to connect the top and bottom layers, achieving non-delamination of the fabric without separate spacer monofilaments. By guide barining specific jacquard lapping structures, it realizes both layer connection and solid color block jacquard. However, this weaving process only uses ground guide bars and jacquard guide bars, resulting in overlapping patterns and structural layers that limit the layering effect.

A Chinese Patent Application No. CN202110778796.3 discloses a double jacquard warp-knitted fabric and its weaving process, which includes a front wear-resistant layer composed of two ground organization yarns and one jacquard organization yarn, a middle decorative yarn jacquard layer, and a back mesh jacquard layer composed of one jacquard organization yarn. The two ground organization yarns and one jacquard organization yarn form the front wear-resistant layer by looping and create mesh holes on the front surface. The decorative yarn jacquard layer is equipped with 16 or more decorative yarns. The jacquard yarn in the back mesh jacquard layer adopts a weft-inlaying structure. However, this fabric does not have the structure of fishing line+pattern guide bar+weft-inlaying creel+weft-inlaying beam+weft-inlaying fishing line, and its strength is relatively poor.

SUMMARY

Therefore, addressing the above-mentioned issues, the present application provides a preparation process for a warp-knitted jacquard multi-layer jacquard shoe upper fabric, aiming to solve the problems of insufficiently rich jacquard variation layers in existing warp-knitted double jacquard single-layer fabrics, relatively poor fabric strength, and the inability to simultaneously achieve lightweight and breathable effects.

To achieve the above objectives, the present application employs the following technical solutions:

A preparation process for a warp-knitted jacquard multi-layer jacquard shoe upper fabric, which includes:

S1. guide bar setting: selecting RSJ89/2B™ as a knitting machine, wherein the guide bar of the knitting machine comprises: a ground guide bar, a pattern guide bar, and a jacquard guide bar; wherein the ground guide bar comprises: GB1, GB2, and GB77; the pattern guide bar comprises PB3-PB74; the jacquard guide bar comprises a loop-forming jacquard and a weft-insertion jacquard; the guide bars JB75-1 and JB75-2 are loop-forming jacquards, and the guide bars JB76-1 and JB76-2 are weft-insertion jacquards;

S2. guide bar knitting:

the ground guide bars GB1 and GB2 are fully threaded; a threading method of the pattern guide bars PB3-PB74 is to thread according to a designed pattern effect to form any weft-insertion jacquard structure; the ground guide bar GB1 wraps yarns of all other layers through loops and underlaps, and the ground guide bar GB2 wraps and locks yarns of other layers except GB1; through a loop-forming structure of the ground guide bars GB1 and GB2, all weft-insertion yarns are bundled to stabilize a structure of the warp-knitted jacquard multi-layer jacquard shoe upper fabric; through a jacquard design of the pattern guide bar, cooperating with the jacquard of the jacquard guide bar, a multi-layer jacquard structure is formed; yarns threaded by the ground guide bars GB1 and GB77 are laid on a bottom layer of the warp-knitted jacquard multi-layer jacquard shoe upper fabric.

Further, the guide bars for threading weft-insertion yarns are: GB77, JB76-1, JB76-2, PB3-PB74.

Further, a full threading specification of the ground guide bar GB1 is 0.1TPEE beam yarn, and a basic lapping structure is 43/01//.

Further, a full threading specification of the ground guide bar GB2 is 100D polyester FDY beam yarn, and a basic lapping structure is 10/01//.

Further, a threading specification of the pattern guide bar PB3-PB74 is 300D cationic pattern creel yarn, and any one of the pattern guide bar PB3-PB74 is independently perform any different lapping.

Further, a threading specification of the jacquard guide bar JB75-1 and JB75-2 is 150D polyester creel yarn, and a basic lapping structure is 00/22//.

Further, a threading specification of the jacquard guide bar JB76-1 and JB76-2 is 150D cationic beam yarn, and a basic lapping structure is 11/00//.

Further, a threading specification of the ground guide bar GB77 is 0.1TPEE beam yarn, and a basic lapping structure is 00/33//.

Further, the 0.1TPEE beam yarn is transparent fishing line.

The beneficial effects of the present application by adopting the aforementioned technical solutions are as follows:

Ground guide bars are responsible for the stability and continuity of the basic structure, forming a flat bottom-layer loop network. Pattern guide bars can independently introduce additional weft-inserted yarns or float structures to form intermediate layers, increasing fabric thickness and three-dimensionality. Jacquard guide bars focus on surface jacquard, forming high-precision patterns through complex lapping movements. In this technical solution, the three types of guide bars collaborate in layers to achieve a three-dimensional weaving effect, whereas traditional weaving technologies only uses ground guide bars and jacquard guide bars, resulting in overlapping patterns and structural layers that limit the layering effect.

The Single-Layer Warp-Knitted Pattern guide bar Jacquard Shoe Material Fabric updated by the machine has following characteristics:

1. On the basis of the double-layer variation of the original warp-knitted double jacquard single-layer fabric, up to 6 variable pattern guide bar layers are added; the ground guide bar is responsible for the basic structure, the pattern guide bar handles the intermediate layer, and the jacquard focuses on jacquard, reducing the load of a single guide bar, reducing the risk of yarn breakage, and improving weaving stability; and a multi-layer structure can be formed at one time, avoiding subsequent composite processing (such as laminating different materials), saving time and cost.
2. Each variable pattern guide bar can shift within a 350-needle range.
3. A fully threaded pattern guide bar (72×3 bars) can theoretically accommodate 72 different yarns to create 72 distinct patterns in separate zones, and by combining with jacquard guide bars, the fabric achieves multi-layered textures.
4. Pattern guide bar materials can range from 75D to 1500D.

The fabric prepared by this technical solution has a structure comprising fishing line+pattern guide bars+weft-insertion creels+weft-insertion beams+weft-insertion fishing line. The usable surface of the fabric is the underlap surface, so the underlaps are on the top and the loop surface is at the bottom. This provides a lightweight and breathable effect while maintaining a certain strength, and the layered textures are more diverse and varied compared to traditional jacquard patterns.

DETAILED DESCRIPTION OF THE EMBODIMENTS

Figure 1:
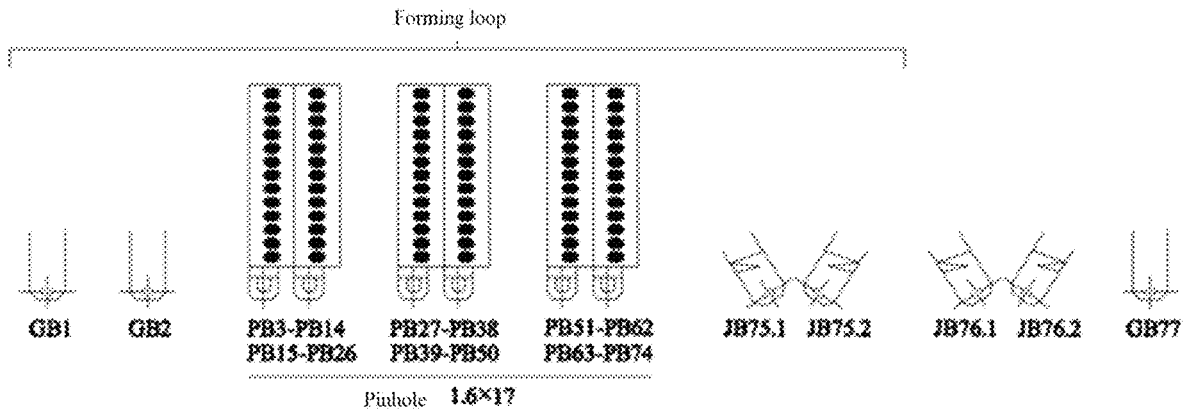
FIG. 1 is a layout diagram of guide bars in an embodiment of the present application.
Figure 2:
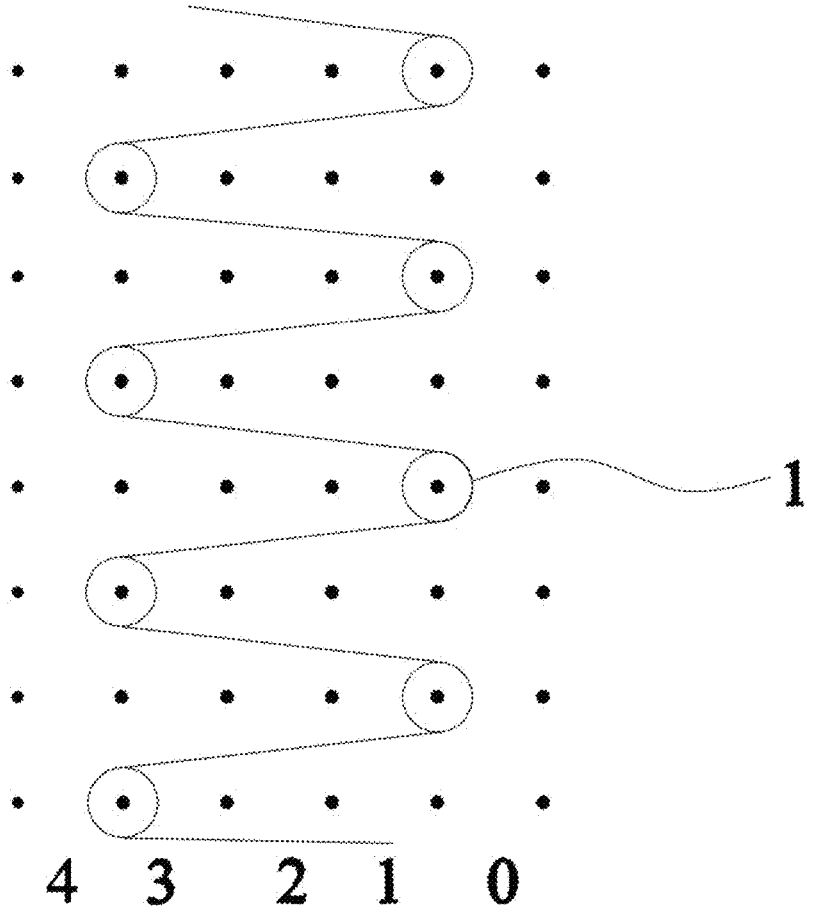
FIG. 2 is a lapping movement diagram of a guide bar GB1 in an embodiment of the present application.
Figure 3:
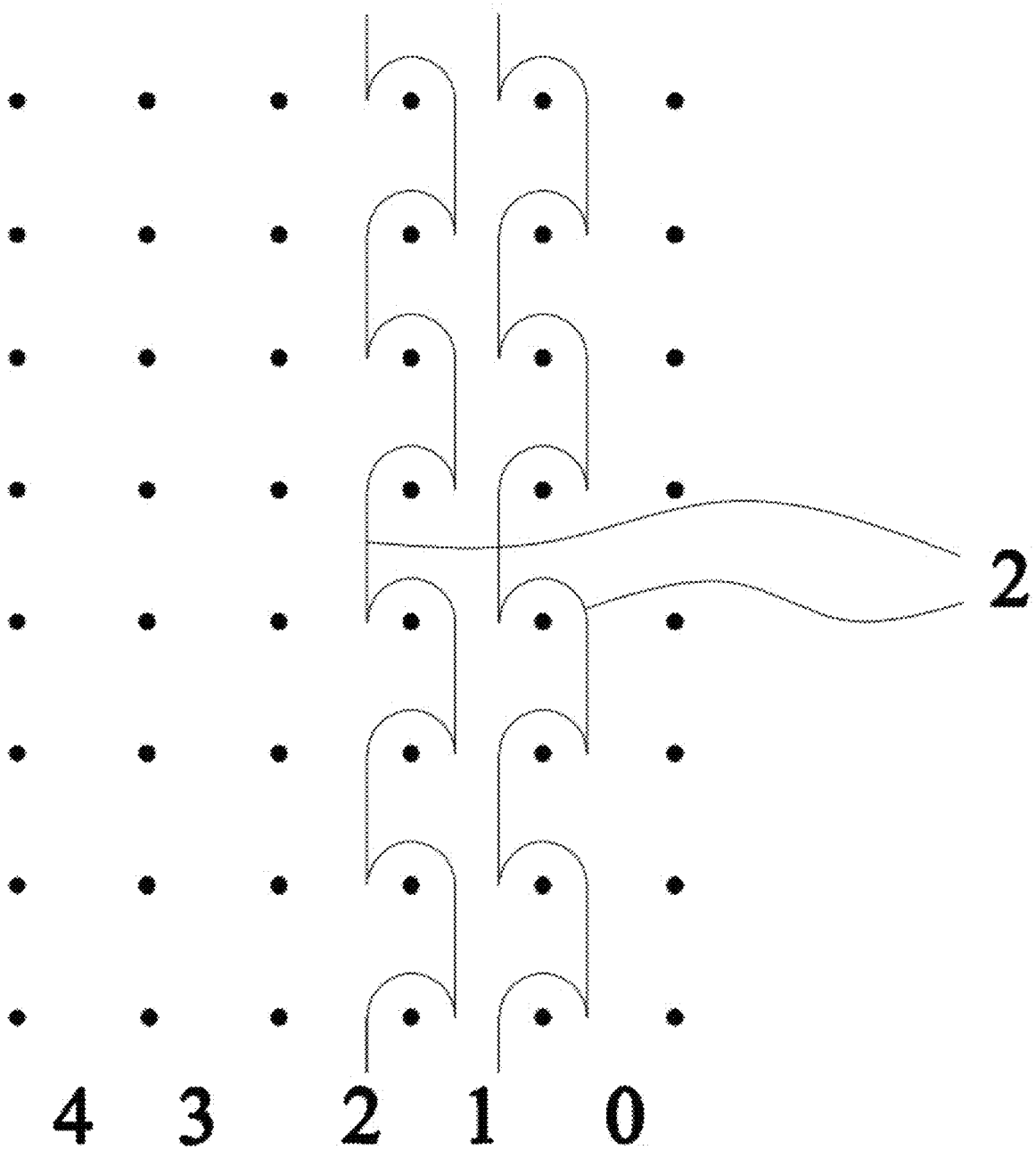
FIG. 3 is a lapping movement diagram of a guide bar GB2 in an embodiment of the present application.
Figure 4:
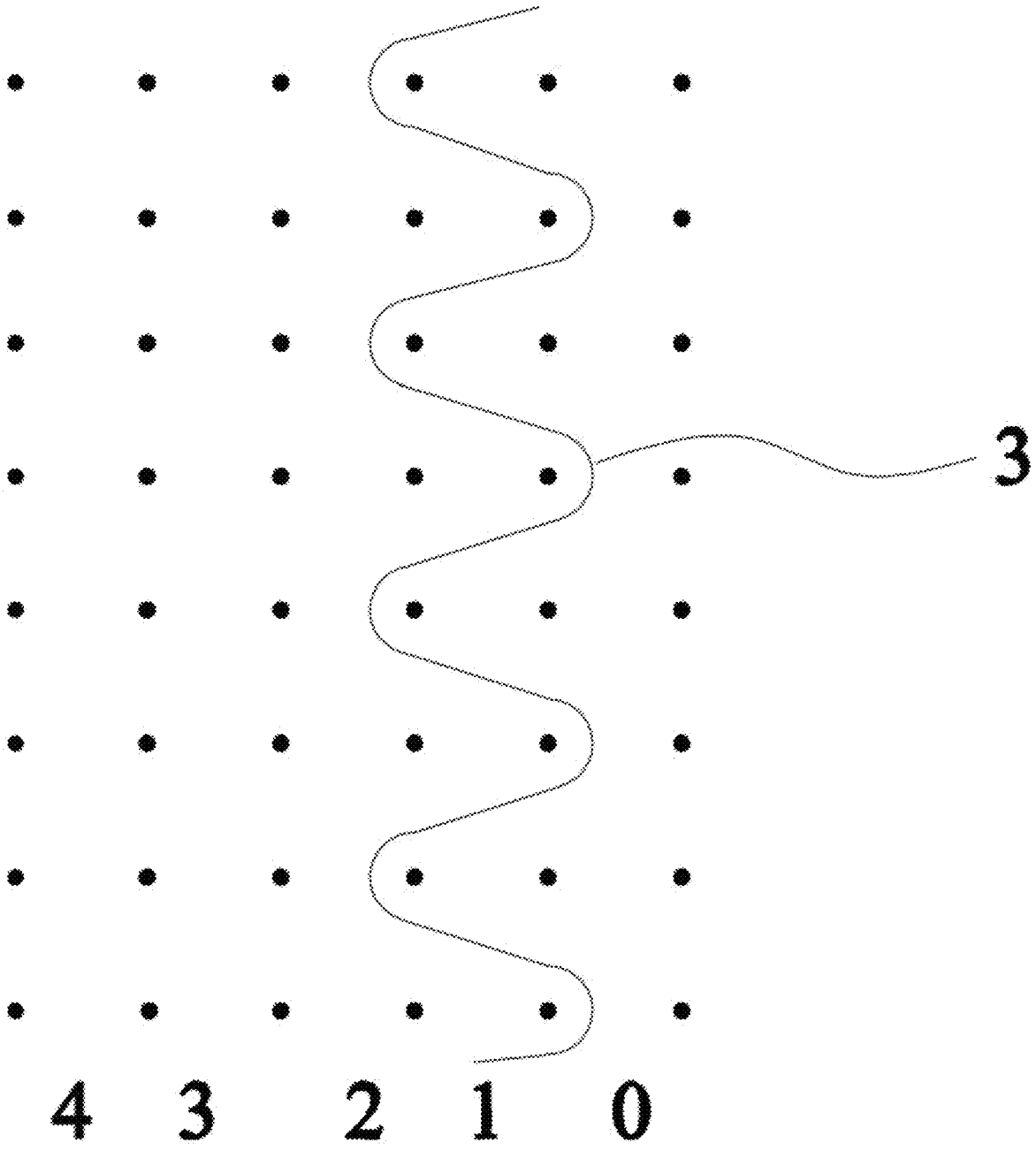
FIG. 4 is a lapping movement diagram of guide bars JB75-1 and JB75-2 in an embodiment of the present application.
Figure 5:
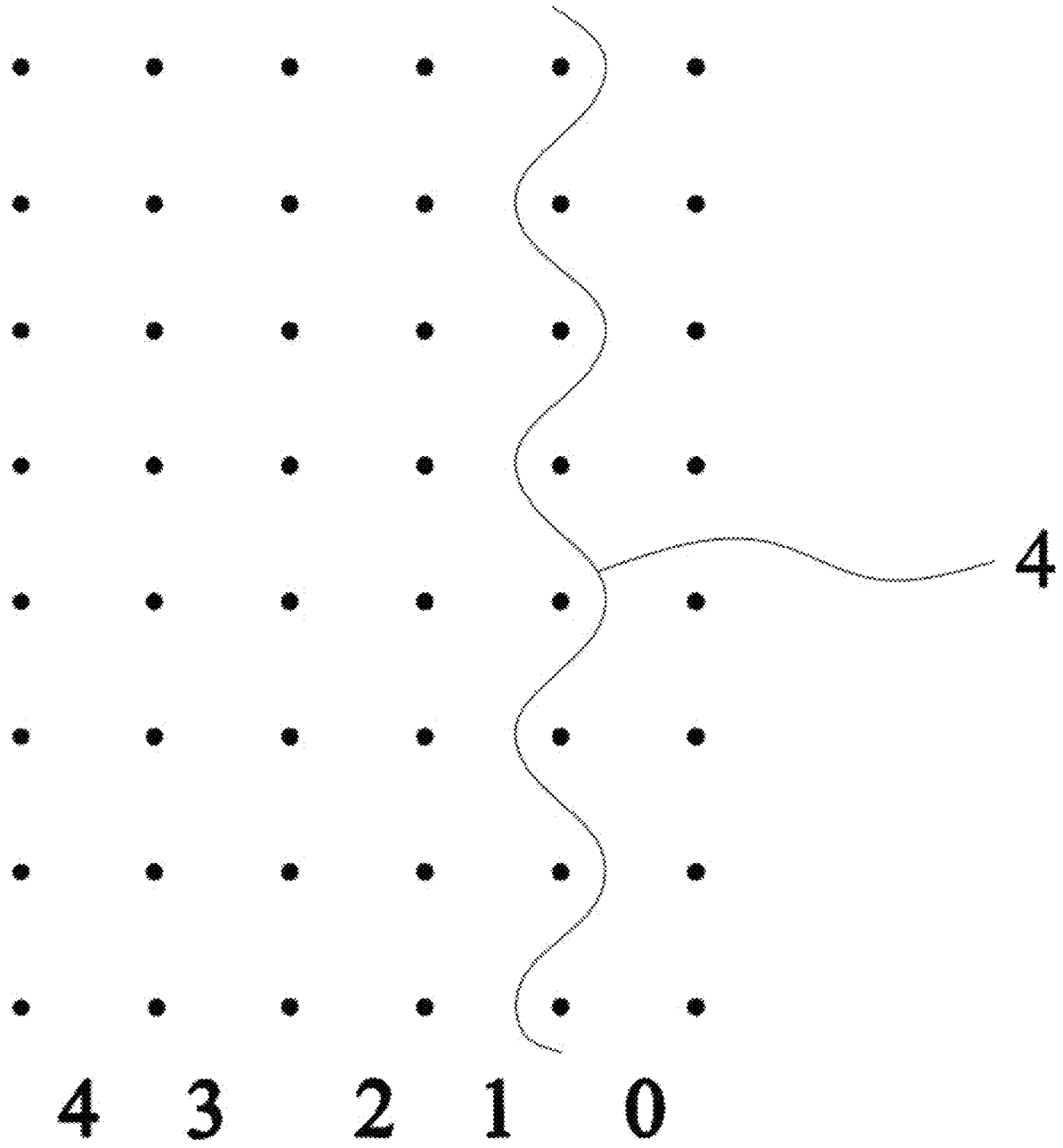
FIG. 5 is a lapping movement diagram of guide bars JB76-1 and JB76-2 in an embodiment of the present application.
Figure 6:
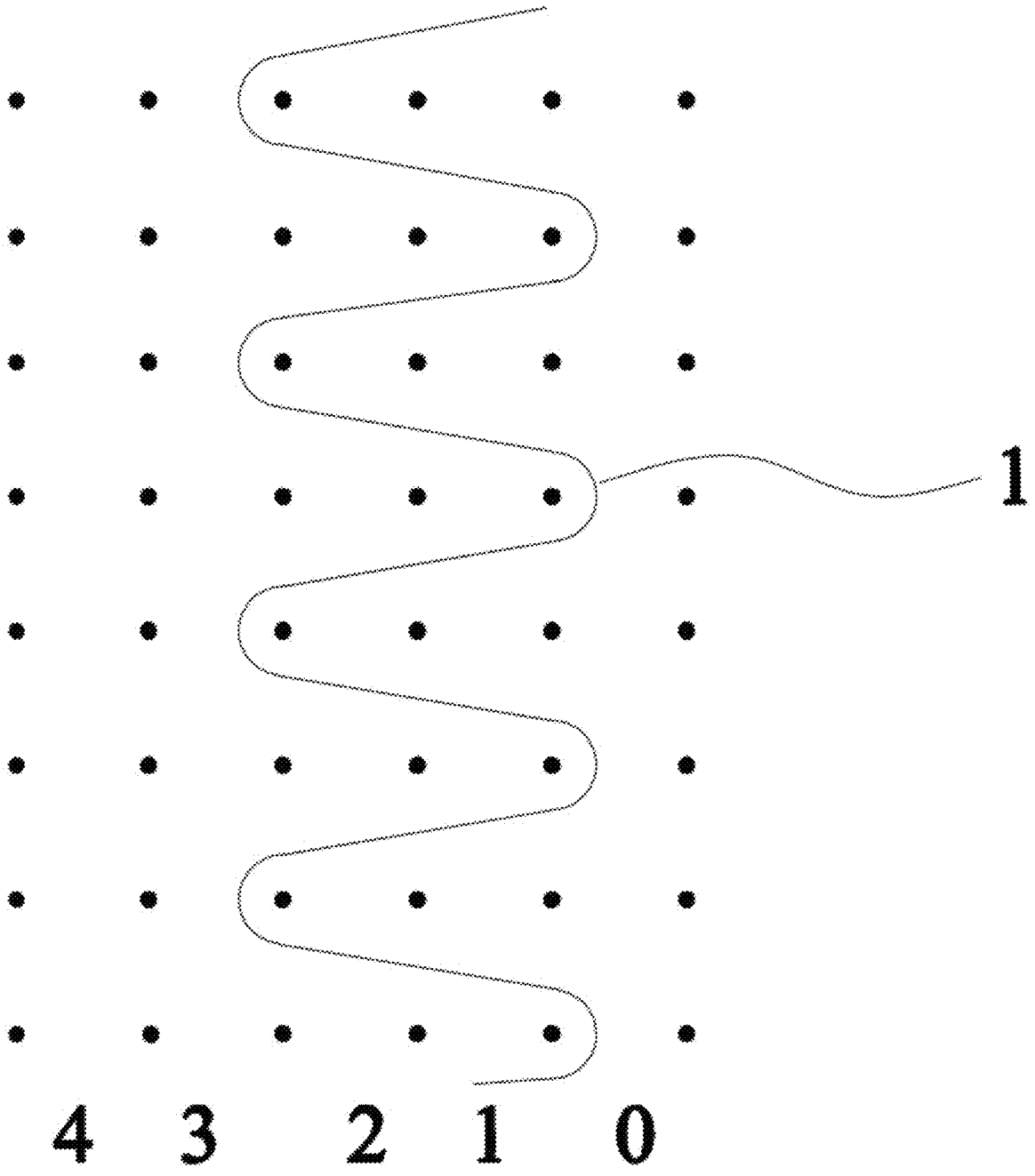
FIG. 6 is a lapping movement diagram of a guide bar GB77 in an embodiment of the present application.
Figure 7:
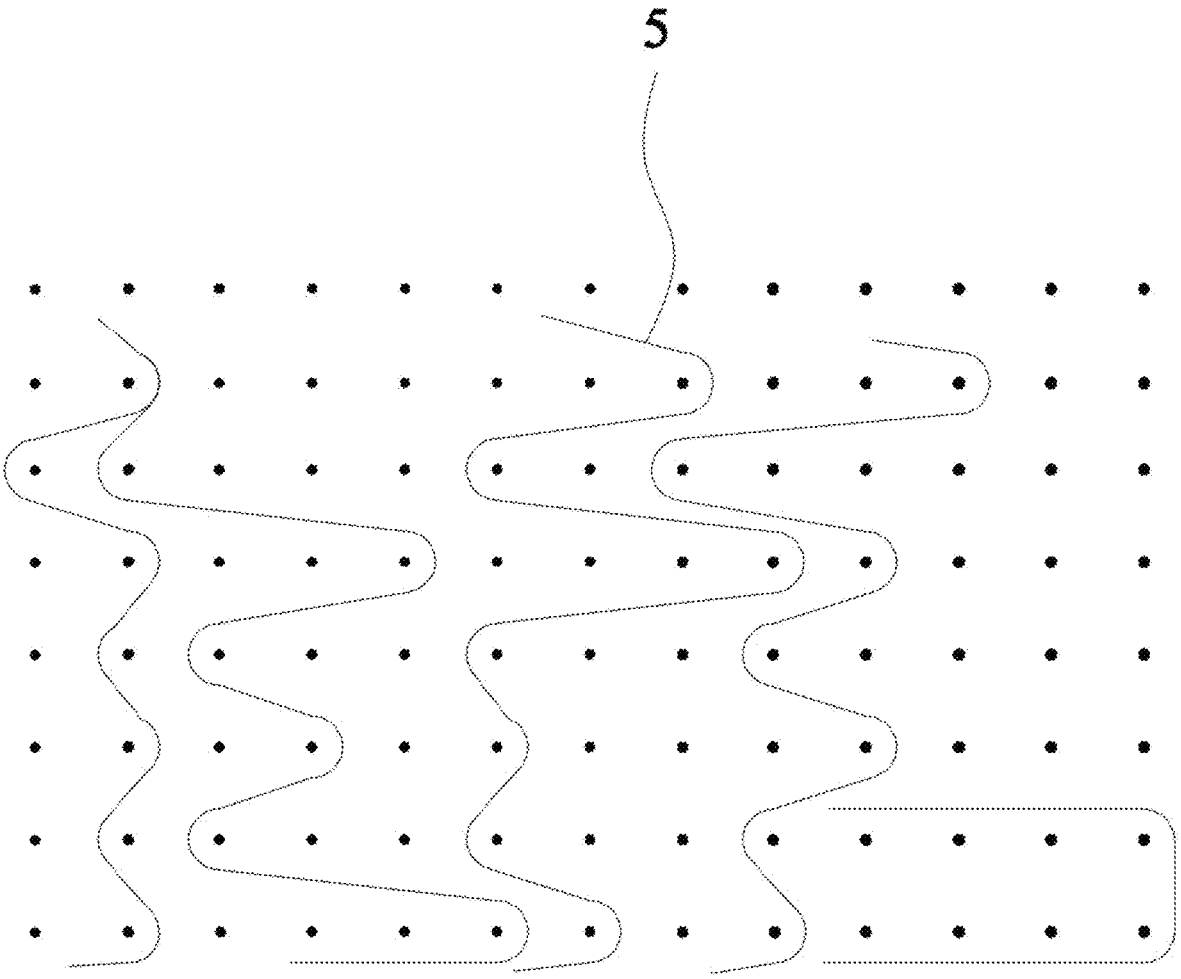
FIG. 7 is a partial lapping movement diagram of pattern guide bars in an embodiment of the present application.

An embodiment of the present application is as follows: with reference to FIGS. 1 to 7, a preparation process for a warp-knitted jacquard multi-layer jacquard shoe upper fabric, which includes:

(1) guide bar setting:

selecting RSJ89/2B™ as a knitting machine, wherein the guide bar of the knitting machine comprises: a ground guide bar, a pattern guide bar, and a jacquard guide bar; wherein the ground guide bar comprises: GB1, GB2, and GB77; the pattern guide bar comprises PB3-PB74; the jacquard guide bar comprises a loop-forming jacquard and a weft-insertion jacquard; the guide bars JB75-1 and JB75-2 are loop-forming jacquards, and the guide bars JB76-1 and JB76-2 are weft-insertion jacquards The weaving machine includes a front needle bed and a back needle bed. The guide bars are arranged in the order from the front needle bed to the back needle bed as follows: GB1, GB2, PB3-PB74, JB75-1, JB75-2, JB76-1, JB76-2, GB77.

(2) Guide Bar Threading and Weaving:

GB1 is fully threaded with 0.1T TPEE beam yarn, lapping basic stitch: 43/01//.

GB2 is fully threaded with 100D polyester FDY beam yarn, lapping basic stitch:

PB3-PB74 are threaded with 300D cationic pattern guide bar creel yarn. Threading method is that arbitrary weft-insertion jacquard stitches are formed according to the designed pattern effect. Any pattern guide bar among PB3-PB74 can independently perform any different lapping movements.

JB75-1 and JB75-2 are threaded with 150D polyester creel yarn, lapping basic stitch: 00/22//.

JB76-1 and JB76-2 are threaded with 150D cationic beam yarn, lapping basic stitch: 11/00//.

GB77 is threaded with 0.1T TPEE beam yarn, lapping basic stitch: 00/33//.

GB1 wraps all other layers of yarns through loops and underlaps.

GB2 locks all layers except GB1.

The 0.1T TPEE beam yarn refers to transparent fishing line.

Guide bars for weft-insertion yarns are GB77, JB76-1, JB76-2, PB3-PB74.

The looping structures of GB1 and GB2 bind all weft-insertion yarns, stabilizing the structure of the warp-knitted jacquard multi-layer shoe upper fabric.

The jacquard design of pattern guide bars, combined with jacquard guide bars, forms a multi-layer jacquard structure.

The transparent fishing line is laid at the bottom layer of the fabric.

The parameters listed for lapping stitches are specific implementation choices of this application; individual stitch modifications also fall within the scope of this application.

The parameters listed for yarn specifications are specific implementation choices of this application; individual specification modifications also fall within the scope of this application.

Although the present application has been specifically shown and described with reference to preferred embodiments, those skilled in the art should understand that various changes in form and details may be made without departing from the spirit and scope of the application as defined by the appended claims, which are intended to be included within the protection scope of this application.

What is claimed is:

1. A preparation process for a warp-knitted jacquard multi-layer jacquard shoe upper fabric, comprising:

S1. guide bar setting: selecting as a knitting machine, wherein the guide bar of the knitting machine comprises: a ground guide bar, a pattern guide bar, and a jacquard guide bar; wherein the ground guide bar comprises: GB1, GB2, and GB77; the pattern guide bar comprises PB3-PB74; the jacquard guide bar comprises a loop-forming jacquard and a weft-insertion jacquard; the guide bars JB75-1 and JB75-2 are loop-forming jacquards, and the guide bars JB76-1 and JB76-2 are weft-insertion jacquards;

S2. guide bar knitting:

the ground guide bars GB1 and GB2 are fully threaded; a threading method of the pattern guide bars PB3-PB74 is to thread according to a designed pattern effect to form any weft-insertion jacquard structure; the ground guide bar GB1 wraps yarns of all other layers through loops and underlaps, and the ground guide bar GB2 wraps and locks yarns of other layers except GB1; through a loop-forming structure of the ground guide bars GB1 and GB2, all weft-insertion yarns are bundled to stabilize a structure of the warp-knitted jacquard multi-layer jacquard shoe upper fabric; through a jacquard design of the pattern guide bar, cooperating with the jacquard of the jacquard guide bar, a multi-layer jacquard structure is formed; yarns threaded by the ground guide bars GB1 and GB77 are laid on a bottom layer of the warp-knitted jacquard multi-layer jacquard shoe upper fabric.

2. The preparation process for the warp-knitted jacquard multi-layer jacquard shoe upper fabric according to claim 1, wherein the guide bars for threading weft-insertion yarns are: GB77, JB76-1, JB76-2, PB3-PB74.

3. The preparation process for the warp-knitted jacquard multi-layer jacquard shoe upper fabric according to claim 1, wherein a full threading specification of the ground guide bar GB1 is 0.1TPEE beam yarn, and a basic lapping structure is 43/01//.

4. The preparation process for the warp-knitted jacquard multi-layer jacquard shoe upper fabric according to claim 1, wherein a full threading specification of the ground guide bar GB2 is 100D polyester FDY beam yarn, and a basic lapping structure is 10/01//.

5. The preparation process for the warp-knitted jacquard multi-layer jacquard shoe upper fabric according to claim 1, wherein a threading specification of the pattern guide bar PB3-PB74 is 300D cationic pattern creel yarn, and any one of the pattern guide bar PB3-PB74 is independently perform any different lapping.

6. The preparation process for the warp-knitted jacquard multi-layer jacquard shoe upper fabric according to claim 1, wherein a threading specification of the jacquard guide bar JB75-1 and JB75-2 is 150D polyester creel yarn, and a basic lapping structure is 00/22//.

7. The preparation process for the warp-knitted jacquard multi-layer jacquard shoe upper fabric according to claim 1, wherein a threading specification of the jacquard guide bar JB76-1 and JB76-2 is 150D cationic beam yarn, and a basic lapping structure is 11/00//.

8. The preparation process for the warp-knitted jacquard multi-layer jacquard shoe upper fabric according to claim 1, wherein a threading specification of the ground guide bar GB77 is 0.1TPEE beam yarn, and a basic lapping structure is 00/33//.

9. The preparation process for the warp-knitted jacquard multi-layer jacquard shoe upper fabric according to claim 3, wherein the 0.1TPEE beam yarn is transparent fishing line.

* * * * *